US005117568A

United States Patent [19]

Mitsui

[11] Patent Number: 5,117,568

[45] Date of Patent: Jun. 2, 1992

[54] ATHLETIC SHOE HAVING STRUCTURE FOR PROTECTING ANKLE AND SHOE TONGUE THEREFOR

[75] Inventor: Shigeyuki Mitsui, Kobe, Japan

[73] Assignee: Asics Corporation, Hyogo, Japan

[21] Appl. No.: 619,950

[22] Filed: Nov. 29, 1990

[30] Foreign Application Priority Data

Dec. 15, 1989 [JP] Japan ..... 1-325717

[51] Int. Cl.[5] ..... A43B 23/26

[52] U.S. Cl. ..... 36/54; 36/89; 36/114

[58] Field of Search ..... 36/54, 50, 89, 133, 36/48

[56] References Cited

U.S. PATENT DOCUMENTS

| | | | |
|---|---|---|---|
| D. 8,761 | 10/1875 | Merritt | 36/50 X |
| Re. 32,585 | 2/1988 | Antonious | 36/50 |
| 102,946 | 5/1870 | Kisheimer | 36/50 |
| 133,225 | 11/1872 | Hersome | 36/50 |
| 145,801 | 12/1873 | Hersome | 36/50 |
| 205,129 | 6/1878 | Packard | 36/54 X |
| 268,994 | 12/1882 | Bray | 36/54 X |
| 749,569 | 1/1904 | Luks | 36/54 X |
| 773,719 | 11/1904 | Dickson | 36/54 |
| 1,265,281 | 5/1918 | Tweedie | 36/54 |
| 1,439,806 | 12/1922 | Elias | 36/50 |
| 1,683,465 | 9/1928 | Hill | 36/50 |
| 2,007,157 | 7/1935 | Cockrum | 36/54 X |
| 2,673,405 | 3/1954 | Gossner | 36/50 X |
| 4,149,323 | 4/1979 | Roy | 36/54 X |
| 4,577,419 | 3/1986 | Chassaing | 36/89 |
| 4,670,998 | 6/1987 | Pasternak | 36/50 X |
| 4,724,623 | 2/1988 | Silverman | 36/54 X |
| 4,922,630 | 5/1990 | Robinson | 36/89 |

FOREIGN PATENT DOCUMENTS

| | | | |
|---|---|---|---|
| 0407327 | 3/1934 | United Kingdom | 36/50 |

*Primary Examiner*—Paul T. Sewell
*Assistant Examiner*—Ted Kavanaugh
*Attorney, Agent, or Firm*—Nixon & Vanderhye

[57] ABSTRACT

An athletic shoe comprising a shoe upper, a shoe tongue and a fastener: heights of the front, lateral and medial sides of the shoe upper are lower than that of the rear side; the upper end of the shoe tongue extends in the right and left directions so that the extended portions may cover the lowered portion of the shoe upper up to a height approximately equal to the rear side of the shoe upper; and the fastener is for tightening the upper end of the shoe upper and the upper end of the shoe tongue surrounding the wearer's ankle portion.

4 Claims, 6 Drawing Sheets

ATHLETIC SHOE HAVING STRUCTURE FOR PROTECTING ANKLE AND SHOE TONGUE THEREFOR

BACKGROUND OF THE INVENTION

1. Field of the Invention

The present invention relates to an athletic shoe having an improved structure of a portion surrounding a wearer's ankle and to a shoe tongue used for the athletic shoe.

2. Prior Arts

For fixing and protecting a wearer's ankle portion and improving close fitness to a foot and ankle, so-called high cut shoe having a structure, in which an opening for inserting a foot is formed at a higher position and the length of a shoe tongue is increased for covering the wearer's ankle, has been generally used.

However, such a high cut shoe is prone to lack stability and give unpleasant feeling to the wearer's instep since the tongue having an increased length is not firmly be secured on the wearer's instep while displaced outwardly and becomes deformed or wrinkled.

Further, since the adjusting section for fixing the ankle and fitting the shoe upper to the ankle portion is located at the front of the ankle, the fixation is limited to result in a problem that the shoe upper cannot be entirely and uniformly fitted to the ankle portion.

Moreover, another problem with such a high cut shoe is that it cannot be put on or taken off unless a shoe string at the front of the shoe upper is loosened, and thus it is laborious and time-consuming to put on or take off the shoe. In addition, it is difficult to put it on or take it off even after loosening the shoe string because the shoe upper is high.

Therefore, an object of the invention is to provide an athletic shoe capable of overcoming the foregoing drawbacks of the conventional high cut shoes and capable of protecting the wearer's ankle portion from physical troubles such as sprain and protecting Achilles' tendon during exercise by covering and fixing the ankle portion up to above the anklebone as well as enabling it extremely easy to put on or take off the shoe while providing excellent fit upon wearing.

DESCRIPTION OF THE INVENTION

The first aspect of the present invention provides an athletic shoe comprising a shoe upper, a shoe tongue and a fastener: heights of the front, lateral and medial sides of the shoe upper are lower than that of the rear side; the upper end of the shoe tongue extends in the right and left directions so that the extended portions may cover the lowered portion of the shoe upper up to a height approximately equal to the rear side of the shoe upper; and the fastener is for tightening the upper end of the shoe upper and the upper end of the shoe tongue surrounding the wearer's ankle portion.

The second aspect of the present invention provides a shoe tongue for the athletic shoe comprising an upper portion extending in the right and left directions for covering at least wearer's anklebone at both lateral and medial sides and a lower portion for covering the wearer's instep.

A high shoe upper referred herein means a shoe upper which can cover the wearer's ankle portion up to a position higher than the anklebone.

The present invention will now be explained with reference to a preferred embodiment of the present invention illustrated in the accompanying drawings.

FIG. 4 is a partial perspective view of the present athletic shoe around the opening at the top of the shoe upper when it is put on;

Figure 1:
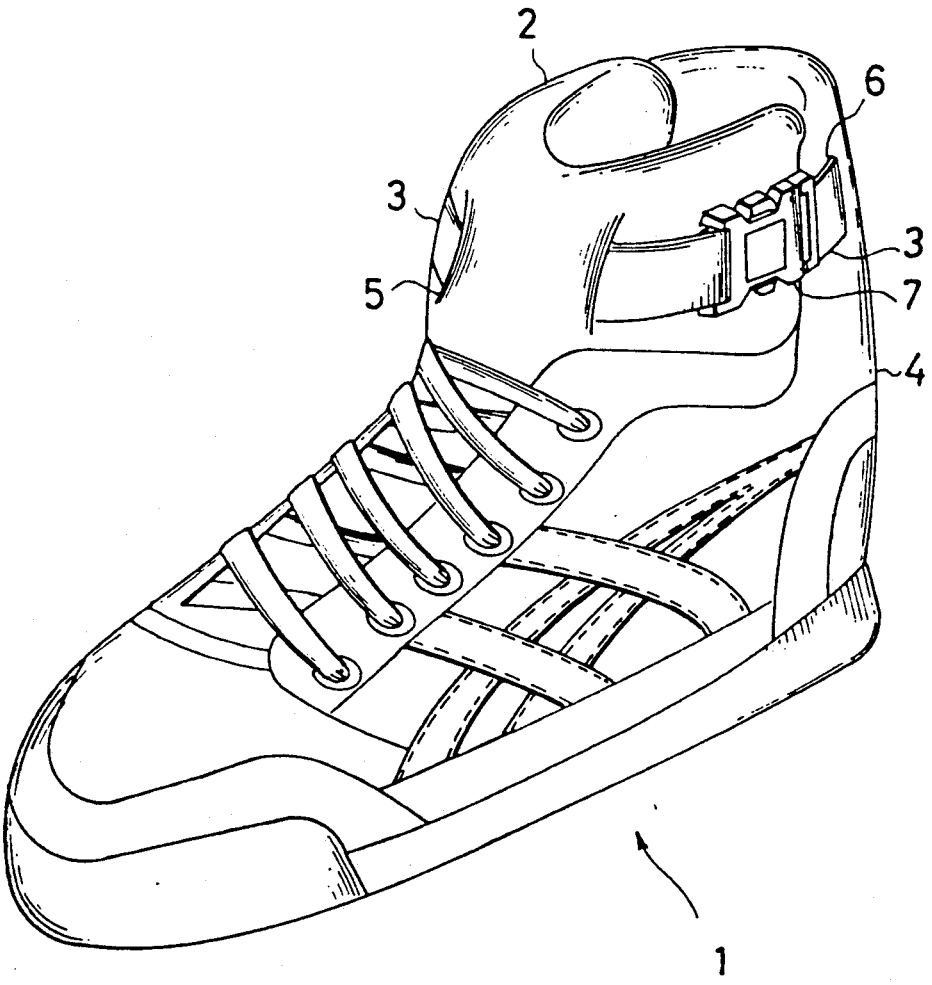
FIG. 1 is a schematic view of the athletic shoe according to the invention.
Figure 2:
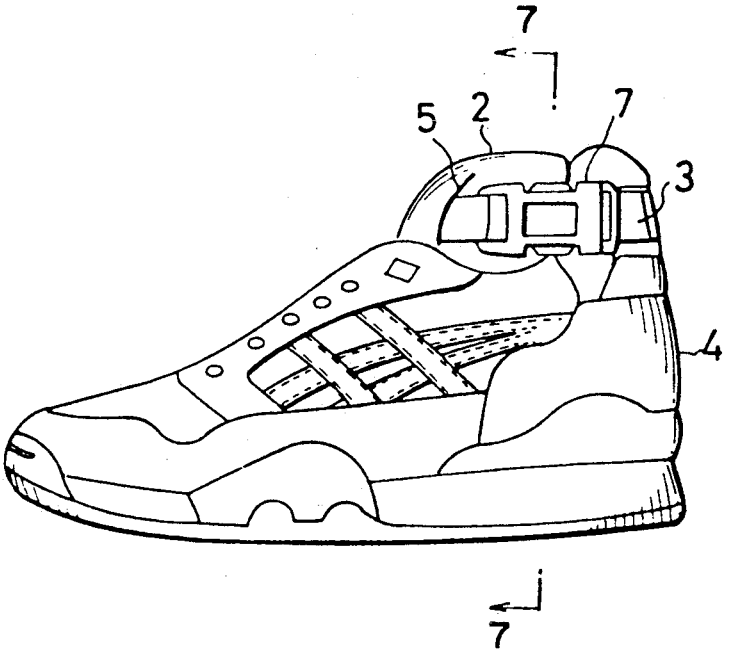
FIGS. 2 and 3 are schematic side view and rear view of the athletic shoe according to the present invention respectively.
Figure 3:
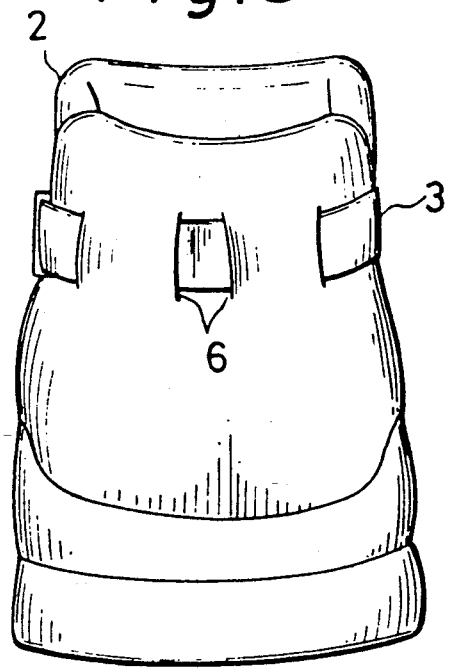
Figure 4:
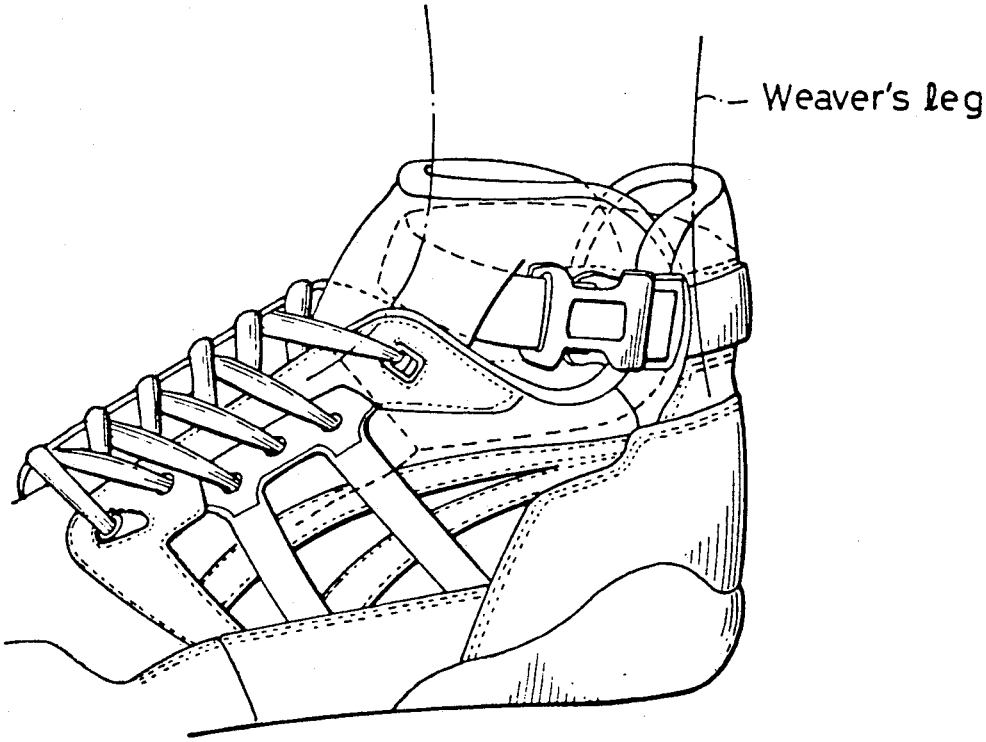
Figure 6A:
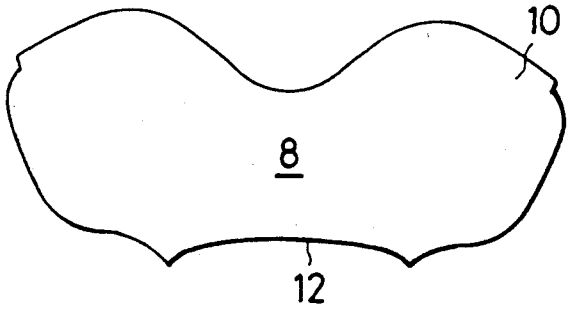
Figure 6A:
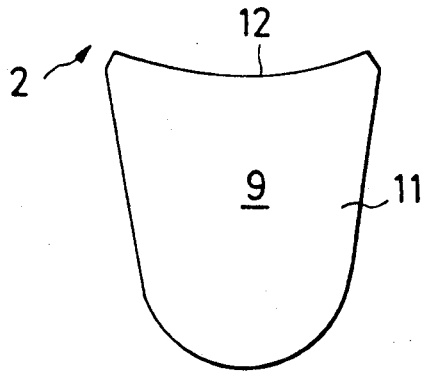
Figure 6B:
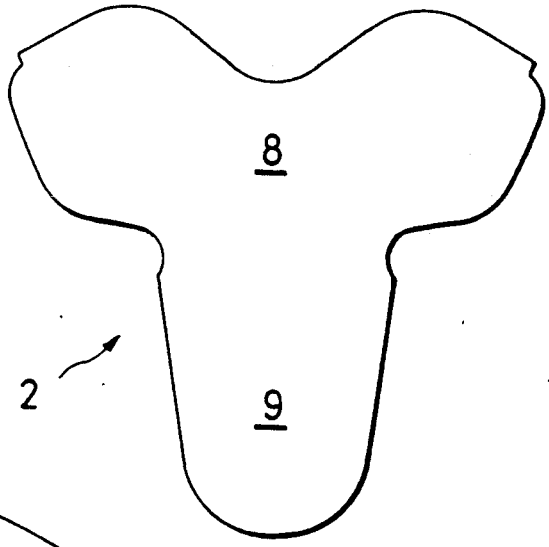
Figure 6C:
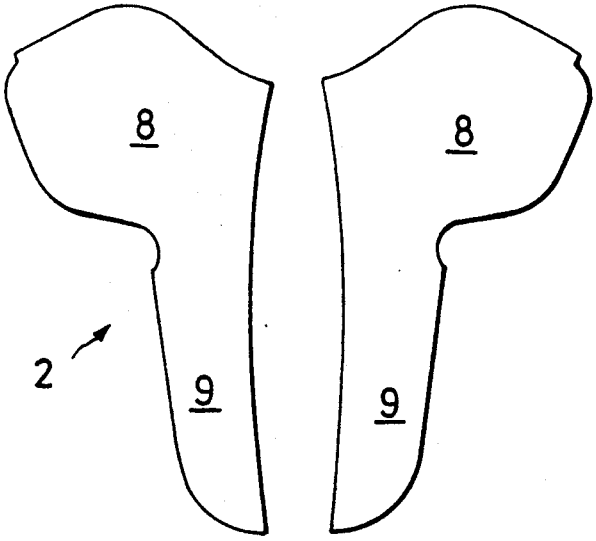
Figure 7:
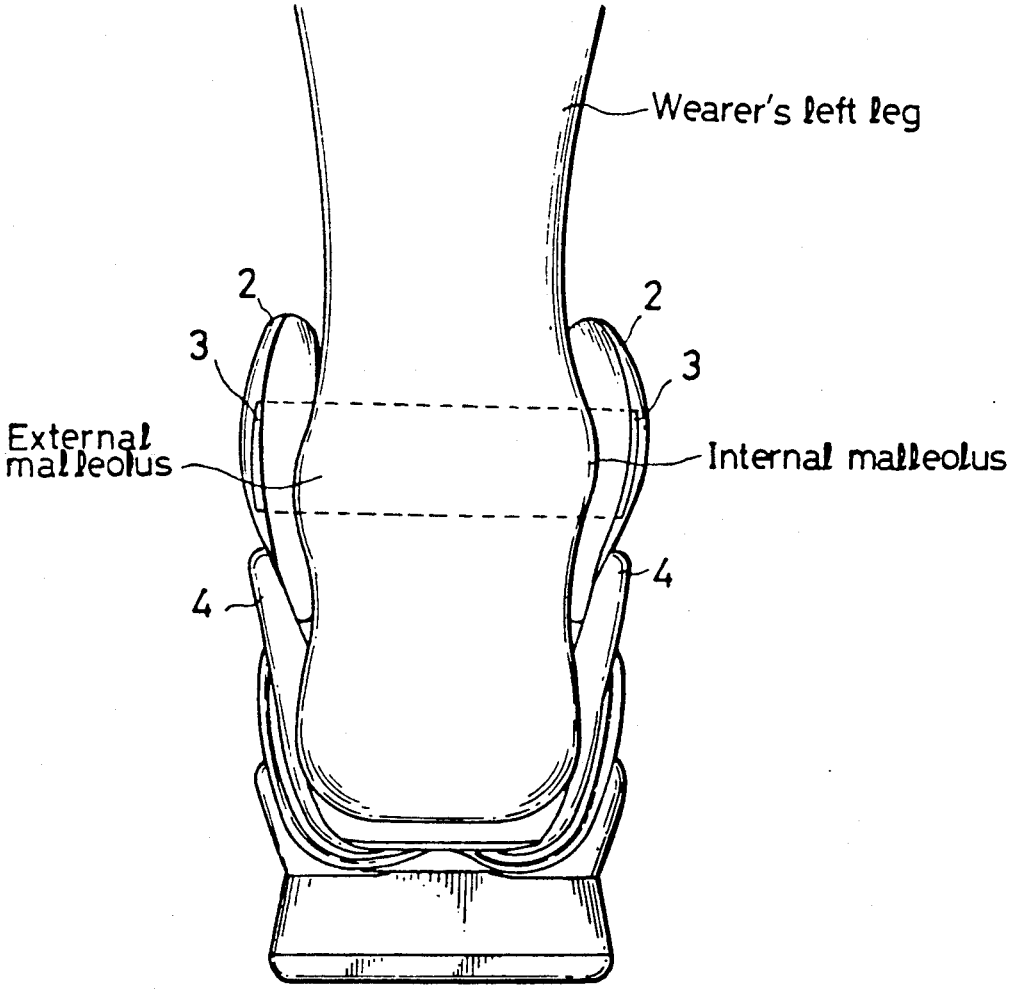
Figure 8:
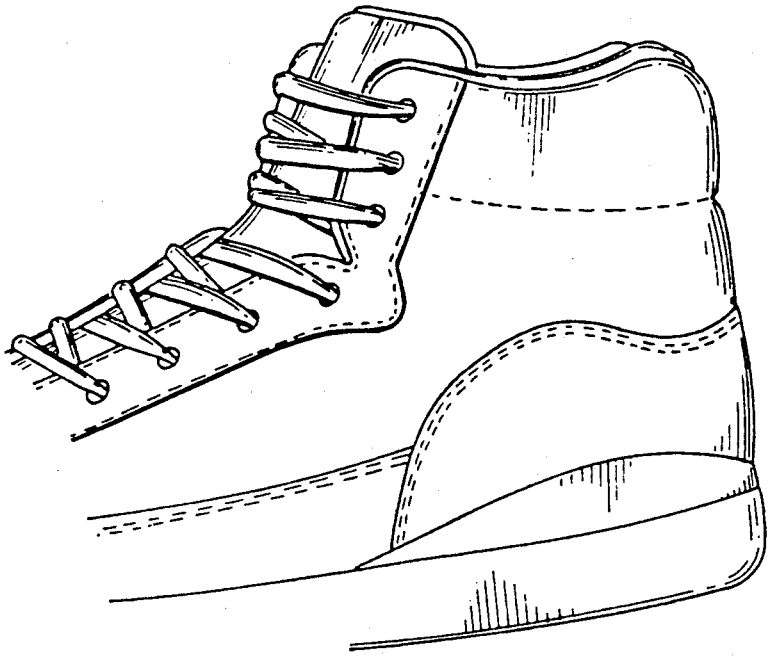
Figure 9:
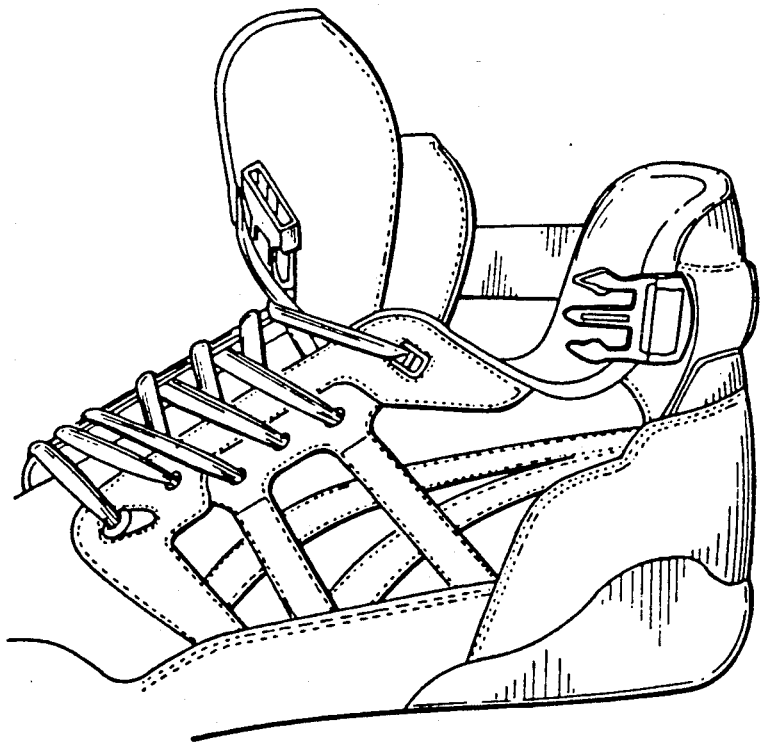

FIGS. 6A to 6C each illustrate a schematic shape of the shoe tongue in a plane view;

FIG. 7 is a cross-sectional view of the shoe according to the invention upon wearing, which is taken along line 7—7 in FIG. 2;

FIG. 8, which is provided for the comparison, is a schematic view of an opening portion of a conventional high-cut athletic shoe; and FIG. 9 represents an opening of the athletic shoe according to the present invention of which fastener is loosened and the upper end of the tongue is turned upwardly.

The athletic shoe 1 according to the present invention shown in FIG. 1 to FIG. 4 has a belt-shaped fastener 3 having a buckle 7 that is inserted through a loop 5 provided at the upper end of a shoe tongue 2 and another loop 6 provided at the upper end of a rear portion of a shoe upper 4 and extends around the opening such that, when it is put on by a wearer, the entire circumference of the opening of the shoe upper may be tighten by the fastener at a position above the wearer's anklebones.

Further, in the athletic shoe according to the present invention shown in FIGS. 1 to 4, the height of the shoe upper is partially lowered at the front and the both lateral sides as compared with the height of the rear portion. On the other hand, the upper end of the shoe tongue, different from those used for the conventional athletic shoes, has an upper end portion extending in both right and left directions such that the extended portions can cover the lowered portion of the lateral sides of the opening.

Figure 5:
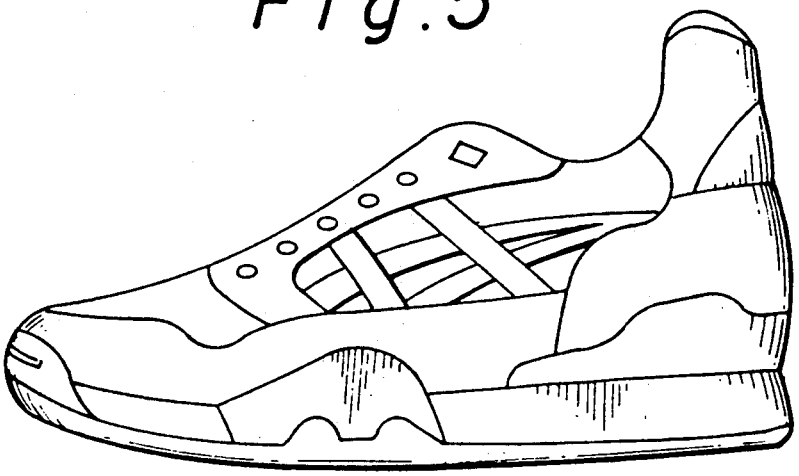
FIG. 5 is a schematic side view of the present athletic shoe with the tongue and the fastener being removed.

For illustrating the structure of the athletic shoe according to the present invention described above, there is shown FIG. 5, which is a schematic side view of the present athletic shoe, with the shoe tongue and the fastener being removed. A schematic view of an opening portion of a conventional high-cut athletic shoe is shown in FIG. 8 for the comparison.

The shoe tongue according to the present invention consists of, as shown in FIGS. 6A to 6C, an upper portion 8 extending in both right and left directions to cover at least both sides of anklebone of the wearer and a lower portion 9 for covering the wearer's instep.

The shoe tongue shown in FIG. 6A comprises a cut piece 10 constituting the upper portion of the tongue and another cut piece 11 constituting the lower portion of the tongue, and both of them are together stitched along a curve 12 to constitute a tongue having a three-dimensional shape conforming the shape of foot from the instep to the ankle portion. Further, the tongue is stitched to the shoe upper at an appropriate portion of the cut piece 11. The tongue according to the present invention may also be formed with an integral one cut piece as shown in FIG. 6B. In case of forming the tongue with a plurality of cut pieces, the shape for each individual cut piece may be freely varied so that a shoe tongue formed by stitching the pieces together having a desired three-dimensional shape can be provided. For example, it may be also formed from cut pieces as shown in FIG. 6C.

The athletic shoe according to the invention having the structure of the tongue and the opening described above, when the fastener is loosened by detaching the buckle and the upper end on the tongue is turned upwardly, substantially has a height of shoe upper equal to that of a so-called low-cut shoe of which shoe upper is lower than the anklebone. Accordingly, it can be put on and taken off extremely easily. FIG. 9 represents an opening of the athletic shoe according to the present invention of which fastener is loosened and the upper end of the tongue is turned upwardly.

The shoe upper itself of the athletic shoe according to the present invention can be manufactured with any of conventional materials such as leather and synthetic leather. The fit of the athletic shoe to the entire ankle portion can be improved by, for example, stitching an elastic member comprising a surface of fluffed nylon fabric, inner packing of urethane sponge and back surface of nylon tricot to the inner surface of the opening portion of the shoe upper.

The tongue may also be manufactured from any of the conventional materials; however, since the shoe tongue of the athletic shoe according to the present invention having the above-described structure functions not only as a tongue of conventional athletic shoe but also substantially as a shoe upper of the conventional athletic shoe, it is preferred to stitch with the same elastic member, as described above for the shoe upper, to the inner surface of the tongue, by which comfortable fit can be obtained. In addition, the tongue of the athletic shoe according to the invention is preferably made to have a three-dimentional shape to suitably fit to the shape of the wearer's ankle portion by constituting the tongue with a plurality of cut pieces, for example, as shown in FIGS. 6A and 6C and by joining them by stitching together, whereby the fitted feeling can be improved further.

The tongue of the athletic shoe according to the invention may be formed as a member which is integral with the shoe upper or, alternatively, it may be formed as a member separate from the shoe upper and attached thereto afterward.

The fastener used for the athletic shoe according to the present invention is preferably a belt having a buckle as described above. The belt may be made from nylon, polyester fabrics, leather and the like cut into a strip, and a buckle made of synthetic resin used for usual sports goods may be employed. Preferred is a buckle which can be attached or detached by a touch of hand and can be tightened without detaching the buckle but merely pulling the end of the belt on which the buckle is mounted.

For firmly fixing the opening portion on the ankle portion, a belt extending around the entire circumference of the ankle portion is preferred, and it is preferably fixed at the opening by being inserted through the loops provided at the upper ends of the tongue and the shoe upper so that it does not detach from the tongue and the shoe upper and it can freely fasten them.

The athletic shoe according to the invention, having the structure described above, provides the following advantages.

Because the fastener is a member independent of the main body of the shoe and can firmly fix the ankle portion uniformly over the entire circumference thereof, it can give the ankle portion better protection and fit than those of any conventional high cut shoe can give.

The wearer's ankle portion is covered with the tongue which is not a part of the shoe upper but is separable therefrom and has a shape such that its upper end extends in the right and left directions and the fastener as described above tightens around the entire circumference the wearer's ankle portion as described above. Therefore, much better fit to the ankle portion than that of any conventional high cut shoe can be obtained, and yet the movement of the ankle portion during exercise is not hindered.

Further, since there is no shoe string at the front of the opening portion as in conventional high cut shoes, it is possible to easily put on and take off the shoe by loosening the fastener and turning the upper end of the tongue upwardly as if it is a low cut shoe.

Moreover, because the tongue is fixed by the fastener and stretched in the direction of the ankle portion upon wearing and because the upper end of the tongue has the extending portions to the both right and left sides, the tongue is less prone to be displaced outwardly upon wearing but can surely be retained on the instep of wearer's foot to always provide satisfactory fitted feeling.

Furthermore, since the fastener, particularly the belt and the buckle attached thereto can be manufactured separately from the main body of the shoe, they can be easily manufactured while applying to them separately desired colorations to provide colorful and fashionable athletic shoes without difficulty.

What is claimed is:

1. An athletic shoe which provides a support region which extends upwardly to a location above the wearer's anklebone and thereby fixes the wearer's ankle, and which also allows the wearer's foot to be easily inserted and removed, said athletic shoe comprising:

a shoe upper having opposed front and rear sides and opposed lateral and medial sides each terminating in an upper edge at a predetermined height such that edge heights of said front, lateral and medial sides of said shoe upper are lower than the edge height of said rear side of said shoe upper;

a shoe tongue having lower and upper portions, wherein said lower portion is sized and configured to cover the wearer's instep, and wherein said upper portion of said shoe tongue includes rightwardly and leftwardly extending covering portions which are sized and configured so as that said upper end of said shoe tongue surrounds at least forward, lateral and medial regions of the wearer's ankle to a height above the wearer's anklebone by covering a space which is collectively defined between (i) the upper edges of the lateral and medial sides of the shoe upper, and (ii) an imaginary line extending forwardly from the upper edge of the rear side of the shoe upper at a height above the wearer's anklebone; and a fastener which removably fastens the shoe upper and the upper end of the shoe tongue which surrounds the wearer's ankle portions.

2. The athletic shoe according to claim 1, wherein said fastener includes a belt and a buckle for fastening terminal ends of the belt to one another, and wherein said upper portion of said shoe tongue and said rear side of said shoe upper include respective slots for accepting the belt therewithin such that the belt surrounds an opening defined by the shoe upper for allowing the wearer's foot to be inserted and removed therefrom.

3. The athletic shoe according to claim 1, wherein said shoe tongue is in the form of an integral one-piece structure.

4. The athletic shoe according to claim 1, wherein said shoe tongue includes a plurality of cut pieces which provide said shoe tongue with a three-dimensional shape.

* * * * *